US011193230B2

(12) United States Patent
Kim et al.

(10) Patent No.: US 11,193,230 B2
(45) Date of Patent: Dec. 7, 2021

(54) METHOD OF CONTROLLING WASHING MACHINE

(71) Applicant: LG Electronics Inc., Seoul (KR)

(72) Inventors: Sunjung Kim, Seoul (KR); Sejin Kang, Seoul (KR)

(73) Assignee: LG Electronics Inc., Seoul (KR)

( * ) Notice: Subject to any disclaimer, the term of this patent is extended or adjusted under 35 U.S.C. 154(b) by 149 days.

(21) Appl. No.: 16/430,988

(22) Filed: Jun. 4, 2019

(65) Prior Publication Data

US 2019/0368099 A1 Dec. 5, 2019

(30) Foreign Application Priority Data

Jun. 4, 2018 (KR) ..... 10-2018-0063988

(51) Int. Cl.

| | |
|---|---|
| ***D06F 35/00*** | (2006.01) |
| ***D06F 23/02*** | (2006.01) |
| ***D06F 37/36*** | (2006.01) |
| *D06F 103/18* | (2020.01) |
| *D06F 105/08* | (2020.01) |
| *D06F 33/42* | (2020.01) |
| *D06F 39/06* | (2006.01) |

(52) U.S. Cl.

CPC ..... *D06F 35/005* (2013.01); *D06F 23/025* (2013.01); *D06F 37/36* (2013.01); *D06F 33/42* (2020.02); *D06F 39/06* (2013.01); *D06F 2103/18* (2020.02); *D06F 2105/08* (2020.02)

(58) Field of Classification Search

None

See application file for complete search history.

(56) References Cited

U.S. PATENT DOCUMENTS

| | | | | |
|---|---|---|---|---|
| 8,448,277 | B2 * | 5/2013 | Fechler | D06F 35/00 8/159 |
| 8,776,297 | B2 * | 7/2014 | Im | D06F 33/00 8/159 |
| 9,080,274 | B2 | 7/2015 | Kim et al. | |
| 2006/0168740 | A1 | 8/2006 | Ha et al. | |

(Continued)

FOREIGN PATENT DOCUMENTS

| | | |
|---|---|---|
| EP | 3051016 | 8/2016 |
| WO | WO2017135602 | 8/2017 |

OTHER PUBLICATIONS

PCT International Search Report in International Application No. PCT/KR2019/006737, dated Sep. 30, 2019, 3 pages.

(Continued)

*Primary Examiner* — Cristi J Tate-Sims

(74) *Attorney, Agent, or Firm* — Fish & Richardson P.C.

(57) ABSTRACT

A method of controlling a washing machine includes washing laundry received in the drum by water mixed with detergent, performing a spin dry operation, and performing a rinse operation. The spin dry operation includes rotating the drum at a spin dry speed to allow the laundry to rotate along with the drum without falling from a highest point of the drum, and draining water from the tub while rotating the drum at the spin dry speed. The rinse operation includes decelerating the drum from the spin dry speed to a laundry adherence speed lower than the spin dry speed, supplying a first water supply to the drum, draining the first water supply from the tub, and supplying a second water supply to the drum.

20 Claims, 6 Drawing Sheets

(56) References Cited

U.S. PATENT DOCUMENTS

| | | | | |
|---|---|---|---|---|
| 2010/0139011 | A1* | 6/2010 | Kim | D06F 34/18 8/159 |
| 2010/0154132 | A1* | 6/2010 | Im | D06F 35/006 8/159 |
| 2011/0099730 | A1 | 5/2011 | Im et al. | |
| 2011/0146002 | A1 | 6/2011 | Kim et al. | |
| 2013/0198969 | A1 | 8/2013 | Kim et al. | |
| 2015/0299926 | A1 | 10/2015 | Kim et al. | |
| 2018/0057991 | A1 | 3/2018 | Bae et al. | |

OTHER PUBLICATIONS

Extended European Search Report in European Application No. 19178236, dated Sep. 5, 2019, 9 pages.
CN Office Action in Chinese Appln. No. 201910480473.9, dated Jul. 9, 2021, 16 pages (with English translation).

* cited by examiner

| | | | | | |
|---|---|---|---|---|---|
| WASH (S1) | FIRST SPIN DRY (S2) | FIRST RINSE(S3) | HYGIENE CLEANING (S4) | SECOND RINSE (S5) | SECOND SPIN DRY (S6) |

METHOD OF CONTROLLING WASHING MACHINE

CROSS-REFERENCE TO RELATED APPLICATION

This application claims the priority benefit of Korean Patent Application No. 10-2018-0063988, filed on Jun. 4, 2018, the disclosure of which is incorporated herein by reference.

BACKGROUND OF THE INVENTION

1. Field of the Invention

The present invention relates to a method of controlling a washing machine in which a tub is rotated about a horizontal axis.

2. Description of the Related Art

A washing machine having a nozzle for spraying water supplied from an exterior water source into drum and using the nozzle for a rinse cycle or a spin dry cycle is a well known type of washing machine. As an example of such an washing machine, Korean Patent Application Publication No. 10-2014-0037084 (hereinafter, referred to as Related Art) discloses a washing machine including a circulation nozzle for spraying circulating water and a direct water nozzle for directly spraying water supplied from the water source.

The Related Art discloses a rinse cycle of rinsing laundry using the circulation nozzle and the direct water nozzle. In particular, the Related Art discloses a (turbo rinsing) cycle of rinsing laundry by rotating the drum at a speed 1G or more, where the laundry is rotated while being attached to the drum. In addition, in order to reduce foaming of residual detergent, the Related Art suggests that the amount of the water is preferably set to a degree where the water can be circulated. However, the method for preventing foaming by reducing an amount of water to be used to rinse laundry degrades rinse performance, and thus a longer time period is required for the rinse cycle in order to ensure sufficient rinse performance.

SUMMARY OF THE INVENTION

A first object of the present invention is to provide a method of controlling a washing machine, the method which divides an amount of water supplied after a wash cycle, so that some of the water is used to remove foam made in spin dry and remove high-concentrated residual detergent on laundry, while the rest of the water is used to clean the drum and the tub later (hereinafter, referred to as "tub cleaning").

A second object of the present invention is to provide a method for controlling a washing machine, the method which performs tub cleaning for hygiene purposes in a series of procedures performed to rinse laundry A third object of the present invention is to provide a method for controlling a washing machine, the method which is capable of reducing an amount of water to be used to rinse laundry and improving rinse performance.

A fourth object of the present invention is to provide a method for controlling a washing machine, the method which is capable of rinsing laundry and cleaning a tub at the same time.

A fifth object of the present invention is to provide a method for controlling a washing machine, the method which is capable of reducing foaming in a rinse cycle.

The present invention relates to a method of controlling a washing machine having a drum provided rotatably in a tub for containing water, wherein an introduction hole through which laundry is to be introduced is formed in a front of the drum.

The method includes: a step of washing the laundry introduced into the drum, by adding water mixed with detergent; a step of rotating the drum at a spin dry speed, where the laundry is able to rotate along with the drum while adhered to and not falling from the drum even when the laundry is lifted to a highest point inside the drum, and of draining a tub while the drum is rotated at the spin-dry speed; and a step of decelerating the drum from the spin-dry speed to a laundry adherence speed.

A step of providing a water supply to the drum, a step of draining the tub, and a step of providing a water supply to the drum may be performed while the drum is rotated at the laundry adherence speed.

The laundry adherence speed may be set within a range where, despite a water supply provided while the drum is rotated at the laundry adherence speed, the laundry is able to rotate along with the drum while adhered to and not falling from the drum even when the laundry is lifted to a highest point inside the drum.

The water supply provided while the drum is rotated at the laundry adherence speed may be provided until a water level of the tub reaches a preset first water supply level.

The draining performed while the drum is rotated at the laundry adherence speed may be stopped when a water level of the tub reaches a preset draining water level within a preset draining time period.

The draining performed while the drum is rotated at the laundry adherence speed may be stopped when a preset draining time period elapses before a water level of the tub reaches a preset draining water level.

The laundry adherence speed may be between 60 rpm and 150 rpm.

After the above-described steps are performed, a step of accelerating the drum from the laundry adherence speed to a tub cleaning speed may be further performed.

The method of controlling a washing machine of the present invention divides an amount of water supplied after a wash cycle, so that some of the water is used to remove foaming in spin dry and remove high-concentrated residual detergent on laundry, while the rest of the water is used to clean the drum and the tub later (hereinafter, referred to as "tub cleaning"). Accordingly, water may be consumed efficiently.

Second, tub cleaning is performed for hygiene purposes in a series of procedures performed to rinse laundry. Accordingly, water used in a rinse cycle may be used for tub cleaning, thereby reducing a total amount of water consumption. In addition, as foam and contaminants adhered to a tub or a drum are removed by the tub cleaning, it is possible to prevent secondary contamination of the laundry in the rinse cycle.

Third, after spin dry is performed to remove detergent adhered to laundry, a water level is increased by supplying water to the tub and the laundry is rinsed. Accordingly, an amount of water consumption may be reduced and rinse performance may improve.

Fourth, while the drum is rotated with laundry adhered thereto, rinse and hygiene cleaning are performed. Accordingly, the laundry may be rinsed uniformly and a capability of the laundry adhered to the drum to lift water during the hygiene cleaning may improve.

Fifth, as the tub cleaning can be performed with water used in rising the laundry, it is possible to keep the inside of the tub clean even without an additional tub cleaning course.

Sixth, it is possible to reduce foaming in the rinse cycle.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Figure 1:
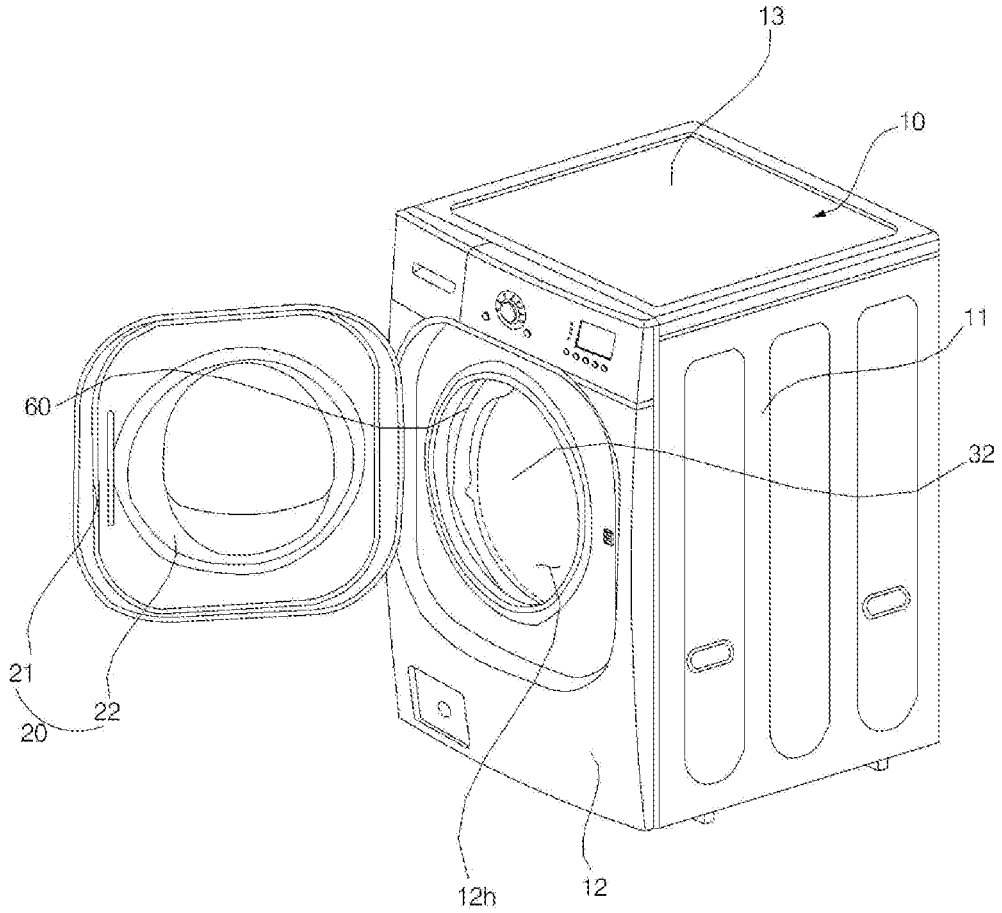
FIG. 1 is a perspective view of a washing machine according to an embodiment of the present invention.

Advantages and features of the present invention and methods for achieving them will be made clear from the embodiments described below in detail with reference to the accompanying drawings. The present invention may, however, be embodied in many different forms and should not be construed as being limited to the embodiments set forth herein. Rather, these embodiments are provided so that this disclosure will be thorough and complete, and will fully convey the scope of the invention to those skilled in the art. The present invention is defined only by the scope of the claims. Like reference numerals refer to like elements throughout the specification.

Figure 2:
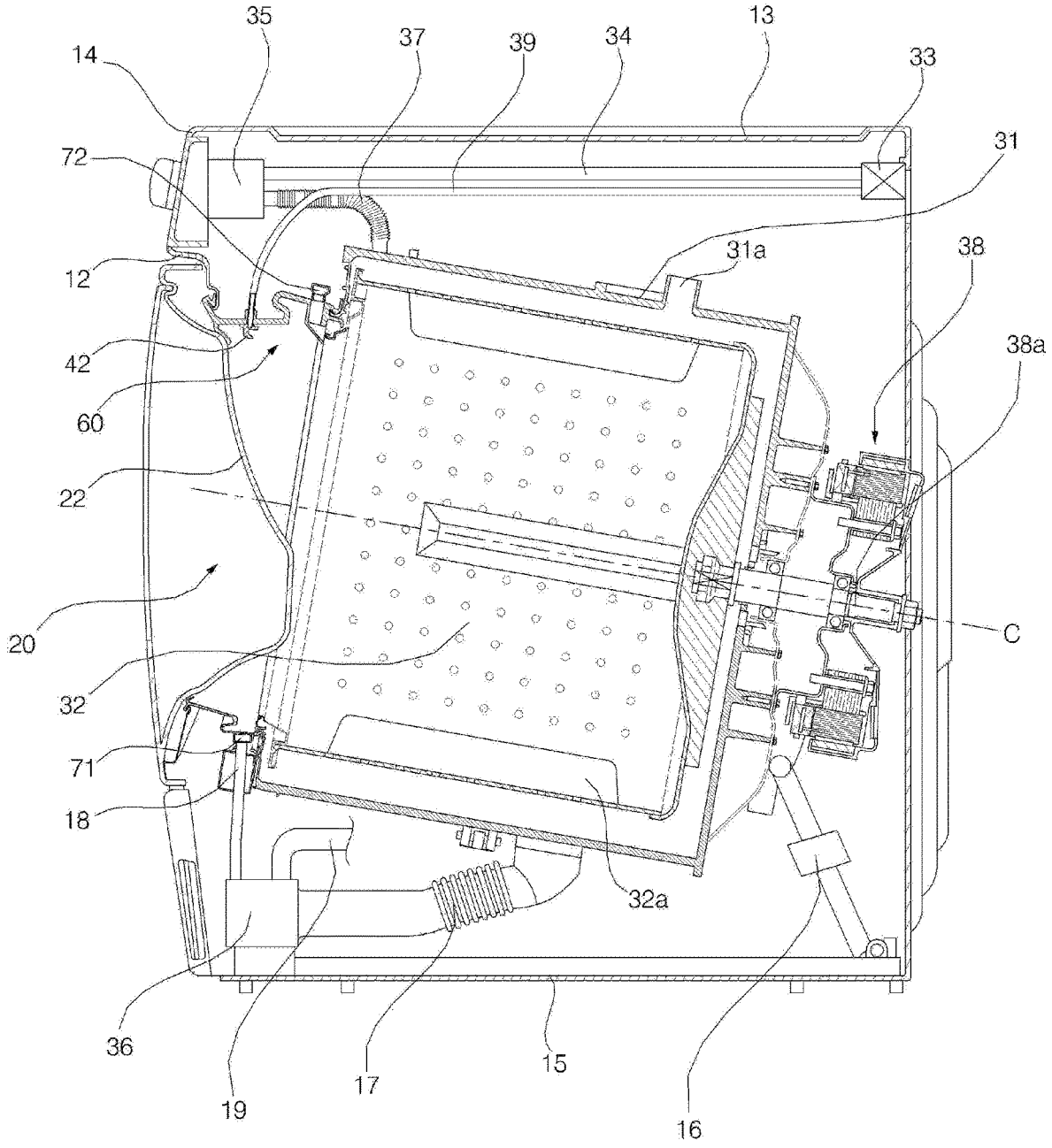
FIG. 2 is a lateral cross-section view of the washing machine shown in FIG. 1.
Figures 3, 4:
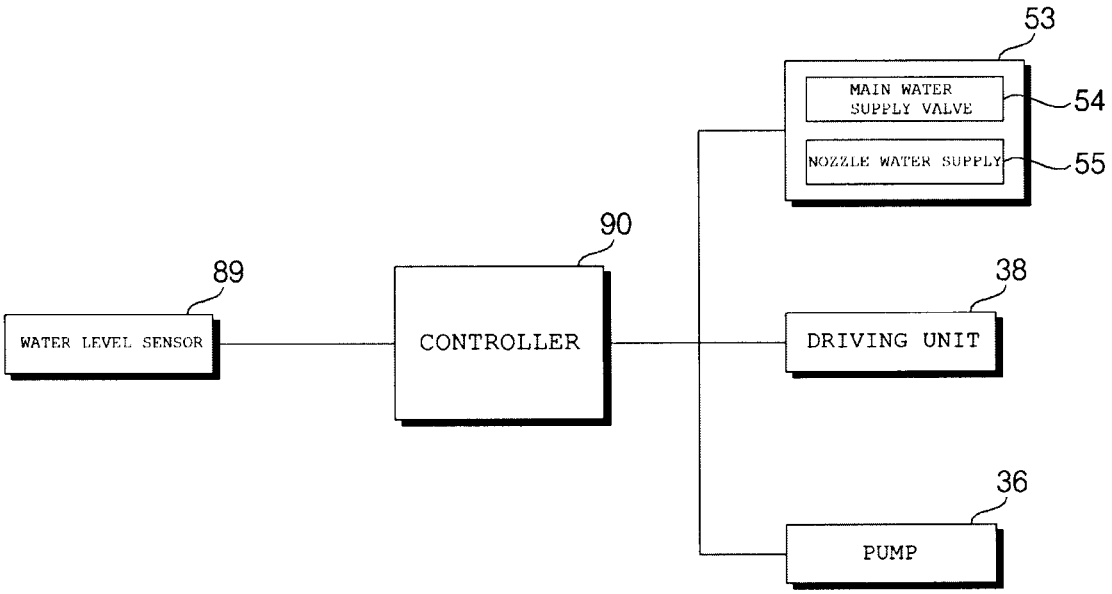
FIG. 3 is a block diagram illustrating a control relationship between major components of a washing machine according to an embodiment of the present invention.
FIG. 4 is a flowchart of a method of controlling a washing machine according to an embodiment of the present invention.

FIG. 1 is a perspective view of a washing machine according to an embodiment of the present invention. FIG. 2 is a lateral cross-section view of the washing machine shown in FIG. 1. FIG. 3 is a block diagram illustrating a control relationship between major components of a washing machine according to an embodiment of the present invention.

Referring to FIGS. 1 to 3, a casing 10 forms an exterior appearance of a washing machine, and an introduction whole 12*h* through which laundry can be introduced is formed on a front of the casing 10. The casing 10 may include a cabinet 11 having an open front surface, a left surface, a right surface, and a rear surface, and a front panel 12 coupled to the open front surface of the cabinet 11 and having the introduction hole 12*h* formed therein.

The bottom and top of the cabinet 11 are open, and a horizontal base 15 supporting the washing machine may be coupled to the bottom of the cabinet 11. In addition, the casing 10 may further include a top plate 13 covering the open top of the cabinet 11, and a control panel 14 over the front panel 12.

A tub 31 for containing water may be disposed in the casing 10. The tub 31 may have an entrance opening formed at the front so that laundry can be introduced into the tub 31. The cabinet 11 and the tub 31 are connected by the annular gasket 60 and thereby a passage for introduction and exit of laundry may be formed in a section from the entrance of the tub 31 to the introduction whole 12*h*.

The door 20 for opening and closing the introduction hole 12*h* may be rotatably coupled to the casing 10. The door 20 may include: a door frame 21 being open approximately at a central portion thereof and rotatably coupled to the front panel 12; and a window 22 installed at the open central portion of the door frame 21. The window 22 may be in a shape convex rearward, at least a portion thereof is positioned in an area surrounded by an inner circumferential surface of the gasket 60.

The control panel 14 may include a display unit 14*a* for displaying an operation state of the washing machine, and an input unit 14*b* for receiving various control commands regarding operation of the washing machine from a user.

A front end and a rear end of the basket 60 are annular, and the gasket 60 is in a tubular shape extending from the front end to the rear end. The front end of the gasket 60 is fixed to the casing 10, and the rear end of the gasket 60 is fixed to the circumference of the entrance opening of the tub 31. The gasket 60 may be formed of a flexible or elastic material. The gasket 60 may be formed of rubber or synthetic resin. When the door 20 is closed, the front end of the gasket 60 is brought into contact with a rear surface of the door 20, thereby preventing that water leaks from the tub 31 through the entrance of the gasket 60.

Hereinafter, a portion defining the inside of the tubular shape of the gasket 60 is referred to as an inner circumferential part (or an inner circumferential surface) of the gasket 60, and a portion opposite thereto is referred to as an outer circumferential part (or an outer circumferential surface) of the gasket 60.

The drum 32 may be rotatably provided in the tub 31. The drum 32 is to receive laundry and disposed with the entrance opening thereof positioned at the front, the entrance opening through which laundry is to be introduced, and the drum 32 rotates about an approximately horizontal axis C. In this case, "horizontal" does not refer to the mathematical definition thereof. That is, even in the case where the axis C is inclined at a predetermined angle relative to a horizontal state, the axis may be considered substantially horizontal if the axis is more like in the horizontal state than in a vertical state. To allow water to flow from the tub 31 into the drum 32, a plurality of through-holes 3 (not shown) may be formed in the drum 32.

A plurality of lifter 32*a* may be provided on an inner surface of the drum 32. The plurality of liters 32*a* may be disposed at a predetermined angle relative to the center of the drum 32. When the drum 32 is rotated, laundry repeatedly goes through an operation of being lifted by the lifter 32*a* and falling.

A driving unit 38 for rotating the drum 32 is further provided. A driving shaft 38*a* to be rotated by the driving unit 38 may penetrate the rear of the tub 31 and be thereby coupled to the drum 32.

Preferably, the driving unit 38 includes a direct drive wash motor, and the wash motor may include a stator fixed to the rear of the tub 31, and a rotor rotating by a magnetic force acting in relation with the stator. The driving shaft 38*a* may rotate integrally with the rotor.

The tub 31 may be supported by a damper 16 installed at the base 15. Vibration of the tub 31 caused by rotation of the drum 32 is attenuated by the damper 16. In some embodiments, although not illustrated, a hanger (e.g., a spring) for hanging the tub 31 to the casing 10 may be further provided.

There may be provided at least one water supply horse (not shown) for guiding water introduced from an external water source such as a water tap or the like, and a water supply unit 33 for controlling the water supplied through the at least one water supply horse to flow to at least one Water supply pipe 34.

A dispenser 35 for supplying additives such as detergent for washing, fabric softener, and the like into the tub 31 or the drum 32 may be provided. The additives are contained in the dispenser 35 separately by types thereof. The dispenser 35 may include a detergent container (not shown) for containing detergent for washing, and a fabric softer container (not shown) for containing a fabric softener.

There may be provided at least one water supply pipe 34 or 39 for guiding water supplied through the water supply unit 33. The water supply unit 33 may include at least one water supply valve for regulating the at least one water supply pipe 34 or 39, respectively.

The at least one water supply pipe 34 or 39 may include: a main water supply pipe 34 for guiding water, supplied through a water supply horse, to the dispenser 35; and a direct water supply pipe 39 for guiding water, supplied through the water supply horse, to a direct water nozzle 42 which will be described later.

The at least one water supply valve may include a main water supply valve 54 for regulating the main water supply pipe 34, and a nozzle water supply valve 55 for regulating the direct water supply pipe 39. The main water supply valve 54 and the nozzle water supply valve 55 are controlled by a controller 90. Hereinafter, although not particularly described, "control" of various electrically operating elements is performed by the controller 90.

The gasket 60 may include a direct water nozzle 42 for spraying water into the drum 32. Water supplied thorough the water supply unit 33 is guided to the direct water nozzle 42 by the direct water supply pipe 39. The direct water nozzle 42 may be a whirl nozzle or a spray nozzle, but aspects of the present invention are not necessarily limited thereto.

Water discharged from the dispenser 35 may be supplied to the tub 31 through a water supply bellows 37. A water supply hole (not shown) connected to the water supply bellows 37 may be formed on a side surface of the tub 31. The water supply bellows 37 is connected to the tub 31. Accordingly, water discharged from the dispenser 35 is supplied primarily to the tub 31. However, water fallen on the surface of the drum 32 may flow into the drum 32 through the through-holes 32*h*. In addition, if the drum 32 is submerged in water as the water level of the tub 31 rises by a water supply, water is supplied to the drum 32 through the through-holes 32*h*. The above two cases shall be defined as the cases where water supply is provided to the drum 32.

A drain hole for draining water may be formed in the tub 31, and a drain bellows 17 may be connected to the drain hole. A pump 36 for pumping water drained from the tub 31 through the drain bellows 17 may be provided. A drain valve (not shown) for regulating the drain bellows 17 may be further provided. The water drained through the drain bellows 17 may be drained to the outside of the washing machine through a drain pipe (not shown).

The pump 36 may selectively perform a draining function of pumping water drained through the drain bellows 17 to the drain pipe, and a circulating function of pumping water to a circulation pipe 18. There are already various well-known technologies for selectively implementing the draining function and the circulating function with one pump, and thus, a detailed description thereof is herein omitted.

However, aspects of the present invention are not limited thereto, and there may be provided a circulation pump connected to the circulation pipe 18 to circulate water and a drain pump connected to the drain pipe to drain water.

The gasket 60 includes a circulation nozzle 72 for spaying water (circulating water) into the drum 32. Water discharged from the pump 36 is supplied to the circulation nozzle 72 through a circulation pipe 18.

The circulation nozzle 72 may be disposed on the gasket 60. Preferably, the circulation nozzle 72 is formed integrally with the gasket 60. The circulation nozzle 72 may be provided as a plurality of circulation nozzles formed on an inner circumferential part of the gasket 60.

A conduit 71 may include a tubular pipe (not shown) extending along an outer circumferential part of the gasket 60, and a plurality of discharge ports (not shown) protruding from the pipe and passing through the gasket 60. The plurality of discharge ports may supply circulating water to the plurality of circulation nozzles 72, respectively.

Figure 5:
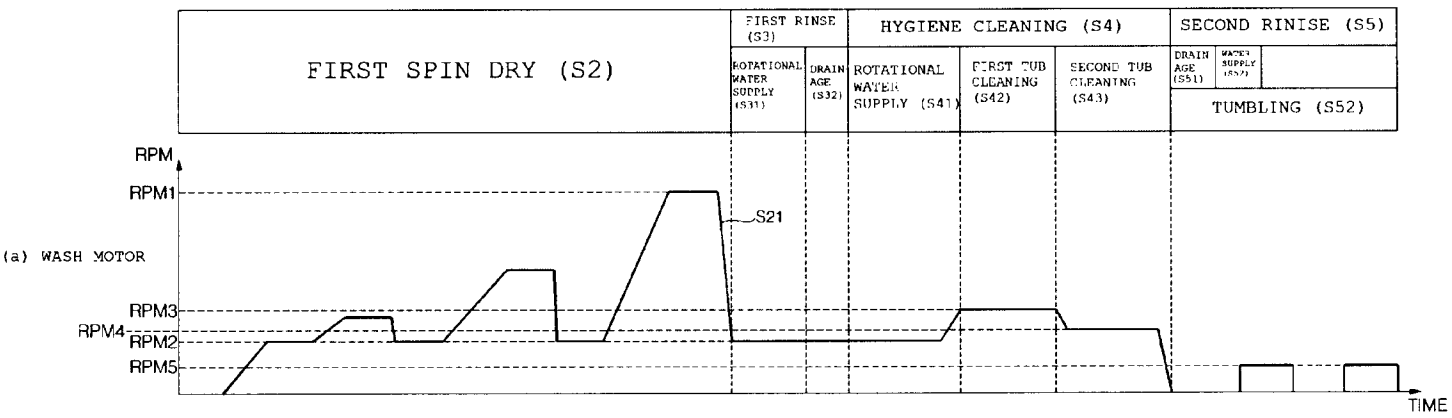
FIG. 5 illustrates steps of FIG. 4 in more details in the form of a graph showing a rotational speed of a wash motor in each step.
Figure 6A:
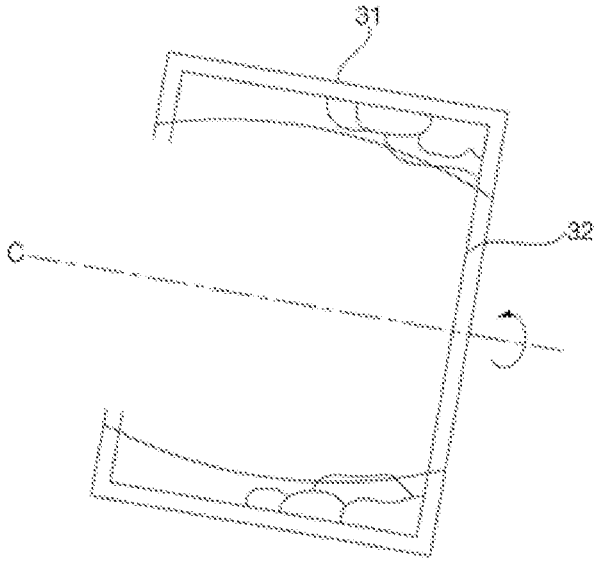
FIG. 6A illustrates the form of a water current developed in a tub in a first tub cleaning step.
Figure 6B:
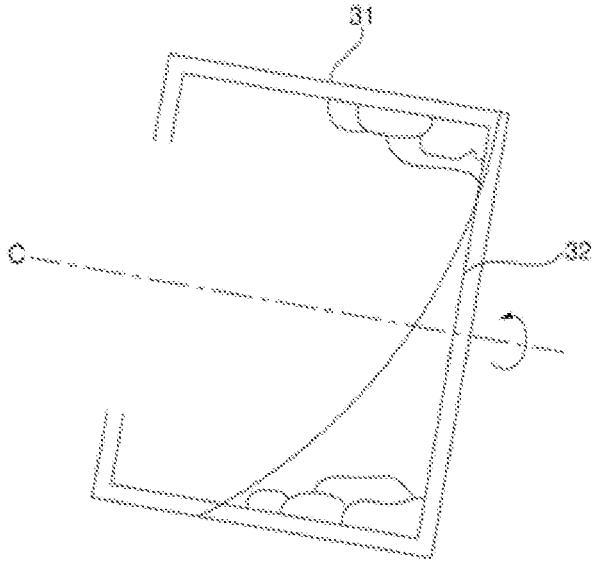
FIG. 6B illustrates the form of a water current developed in a tub in a second tub cleaning step.
Figure 7:
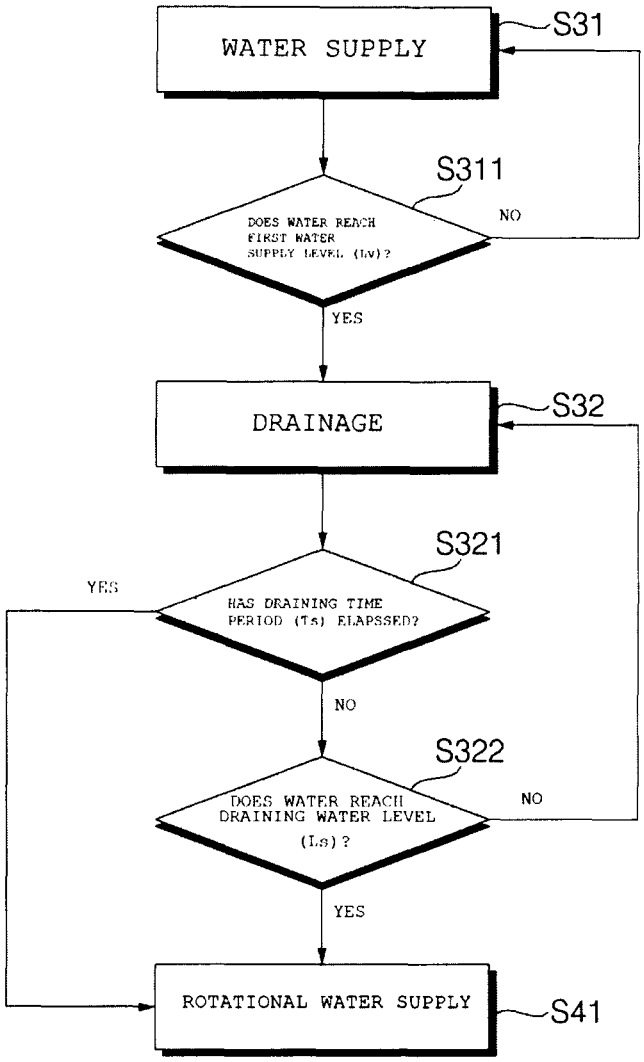
FIG. 7 is a flowchart illustrating details from step S31 to S41.

FIG. 4 is a flowchart of a method of controlling a washing machine according to an embodiment of the present invention. FIG. 5 illustrates steps of FIG. 4 in more details in the form of a graph showing a rotational speed of a wash motor in each step. FIG. 6A illustrates the form of a water current developed in a tub in a first tub cleaning step, and FIG. 6B illustrates the form of a water current developed in a tub in a second tub cleaning step. FIG. 7 is a flowchart illustrating details from step S31 to S41.

Referring to FIGS. 4 to 7, a method of controlling a washing machine according to an embodiment of the present invention includes a step S1 of washing laundry introduced in a drum 32 by adding water mixed with detergent to the laundry.

A main water supply valve 54 is opened to supply water together with detergent through the dispenser 35, and the drum 32 is driven in a predetermined pattern to wash the laundry.

Then, a first spin dry step S2 of draining the tub 31 and spin-drying the laundry is performed. The first spin dry step S2 includes a step of rotating the drum 32 at a preset spin dry speed. At the spin dry speed, the laundry rotates along with the drum 32 while adhered to and not falling from the drum 32 even when the laundry is lifted to the highest point in the drum 32. The spin dry speed is not necessarily set to one value, but the spin dry speed may be set to various values, as shown in FIG. 5, such that a speed value at each step where the drum 32 is maintained at a constant speed may be sequentially increased.

While the drum 32 is rotated at the spin dry speed, the tub 31 is drained. The pump 36 is operated in a drain mode, and, in some embodiments, if a drain pump is provided, the drain pump is operated. Furthermore, in the case of a natural drainage-based washing machine where a pump for drainage is not provided, a drainage valve (not shown) for regulating a drainage bellows 17 is opened.

Next, a first rinse step S3 is performed. The first rinse step S3 includes a step of decelerating the drum 32 from the spin dry speed RPM1 to the laundry adherence speed RPM2.

While the drum 32 is decelerated from the spin dry speed RPM1 (S21), a water supply may be provided. In this case, the water supply may be provided through the dispenser 35 and/or the direct water nozzle 42. Hereinafter, although not particularly described, "water supply" is defined as being able to be performed through any one of the dispenser 35 and the direct water nozzle 42.

However, the water supply during the deceleration of the drum 32 in the step S21 is preferably provided through the dispenser 35, and a start time of the water supply is preferably in sync with a start time of the deceleration of the drum 32. While the drum 32 is rotated at a maximum speed RPM1, water splashes on the outer surface of the drum to thereby form a water current dispersing toward an inner side surface of the tub 31. As a result, the effect of cleaning the inner surface of the tub 31 may be achieved. While the drum 32 is rotated at the laundry adherence speed RPM2, the steps S31, S32, and S41 are performed.

In the step S31, a water supply is provided to the drum 32. The water supply is provided when draining is stopped, and thus, a water level of the tub 31 is gradually increased with progress of the water supply. The water supply in the step S31 may be controlled based on a value detected by a water level sensor 89. That is, if a water level detected by the water level sensor 89 reaches a preset first water supply level Lv, the controller 90 may stop supplying water (which corresponds to "Yes" in step S311). Due to the water supply in the step S31, residual detergent on the laundry may be dissolved and diluted.

In the step S32, the tub 31 is drained. In this case, the detergent separated from the laundry by the water supply in the step S31 is drained together with water.

Meanwhile, the laundry adherence speed RPM2 is set within a range where laundry is able to rotate along with the drum 32 while adhered to and not falling from the drum 32 even when the laundry is lifted to the highest point inside the drum 32 even in the case where a water supply is provided in the step S31 and the step S41. The laundry adherence speed RPM2 may be set approximately between 60 rpm and 150 rpm and may be preferably 108 rpm, but aspects of the present invention are not necessarily limited thereto. Furthermore, the laundry adherence speed RPM2 may be set by an amount of laundry (hereinafter, referred to as laundry load) introduced into the drum 32. The larger laundry load is, the more central area the laundry is positioned in the drum 32. In this case, in order to rotate the drum 32 with the laundry adhered to the inner surface of the drum 32, a greater centrifugal force is required. Accordingly, the controller 90 may set the laundry adherence speed RPM2 to a higher value if a larger laundry load is detected by a laundry load detecting means (not shown).

Meanwhile, the draining in the step S32 may be stopped when the water level of the tub 31 reaches a preset draining water level Ls within a preset draining time period Ts since the beginning of the draining (which corresponds to "Yes" in the step S322). Yet, when the draining time Ts has elapsed, the draining may be stopped even before the water level of the tub 31 reaches the preset draining water level Ls (which corresponds to "Yes" in step S321).

Meanwhile, in the step S41, a water supply may be provided until the water level of the tub 31 reaches a preset second water supply level. The second water supply level may be set to the same value as the first water supply level, but aspects of the present invention are not necessarily limited thereto. At the second water supply level, at least a portion of the drum 32 is submerged in water in the tub 31.

A hygiene cleaning step S4 of accelerating the drum 32 from the laundry adherence speed RPM2 to a tub cleaning speed RPM3 or RPM4 may be performed. The hygiene cleaning step S4 is performed while draining is stopped. The tub cleaning speed RPM3 or RPM4 is preferably set between 130 rpm and 200 rpm, but aspects of the present invention are not necessarily limited thereto.

The hygiene cleaning step S4 is performed while a large amount of detergent is removed from laundry by the water supply in the step S31 and the draining in the step S32, and less foam is made in the hygiene cleaning step S4.

The hygiene cleaning step S4 may include a first tub cleaning step S42 of rotating the drum 32 at a first tub cleaning speed RPM3, and a second tub cleaning step S43 of rotating the drum 32 at a second tub cleaning speed RPM4.

Preferably, the first tub cleaning speed RPM3 is higher than the laundry adherence speed RPM2. During rotation of the drum 32, water contained in the tub 31 may give impact to laundry in the drum 32 to cause the laundry to come off the drum 32 and furthermore cause movement of the laundry. Nonetheless, since the drum 32 is rotated at the first tub cleaning speed RPM3 higher than the laundry adherence speed RPM2, the laundry may remain adhered to the drum 32 despite the impact by water currents on the laundry. That is, it is preferable that the first tub cleaning speed RPM3 is set within a range where laundry is able to rotate along with the drum 32 while adhered to the drum 32 even when the drum 32 is being rotated in a submerged state in water.

While the drum 32 is rotated at the first tub cleaning speed RPM3, a water current may be formed in the tub 31 by friction with the drum 32. In addition, a water current allowing laundry to rotate along with the drum 32 may be formed by the lifters 32*a* in the drum 32 or by a lifting operation of the laundry adhered to the drum 32. The tub 31 or the drum 32 may be cleaned by these water currents.

In addition, as in the present embodiment, when the drum 32 with a high front surface is rotated about an inclined rotation axis, the tub 31 may be inclined as well to correspond to the drum 32. In this case, a centrifugal force acting on a water current formed by the rotation of the drum 32 may press water contained between the tub 31 and the drum 32 toward an inner surface of the tub 31. The pressed water current rises along the inclination of the tub 31, reaches the front surface of the tub 31, and is then poured into the drum 32 again. In this course, the front of the tub 31 or the drum 32 may be cleaned (see FIG. 6A).

Next, the second tub cleaning step S43 of decelerating the drum 32 from the first tub cleaning speed RPM3 to a second tub cleaning speed RPM4 is performed. At the second tub cleaning speed RPM4, laundry remains adhered to the drum 32.

Since the second tub cleaning speed RPM4 is lower than the first tub cleaning speed RPM3, a water current may not proceed forward further than in the first tub cleaning step S42. Therefore, the rear side of the tub 31 or the drum 32 is primarily washed (see FIG. 6B).

Next, a second rinse step S5 is performed. The second rinse step S5 may include a step S51 of draining water used in the tub cleaning step S42 and S43, and a step S52 of supplying water into the tub 31 to a preset third water supply level after completion of drainage.

In the second rinse step S5, a tumbling operation of rotating the drum 32 in a predetermine direction for a predetermined time after a water supply is provided in the step S52 may be performed. A rotational speed RPM5 of the drum 32 in the tumbling operation may be set within a range where laundry positioned at the lowest point in the drum 32 is able to be lifted to a predetermined height and fall therefrom. The tumbling operation may be repeatedly performed at a predetermined time interval. If the tumbling operation is repeatedly performed, the rotational direction of the drum 32 may switch.

Next, the tub 31 is drained again, and a second draining step S6 of rotating the drum 32 at a preset second spin dry speed may be performed.

The method of controlling a washing machine of the present invention divides an amount of water supplied after a wash cycle, so that some of the water is used to remove foam made in spin dry and remove high-concentrated residual detergent on laundry, while the rest of the water is used to clean the drum and the tub later (hereinafter, referred to as "tub cleaning"). Accordingly, water may be consumed efficiently.

Second, tub cleaning is performed for hygiene purposes in a series of procedures performed to rinse laundry. Accordingly, water used in a rinse cycle may be used for tub cleaning, thereby reducing a total amount of water consumption. In addition, as foam and contaminants adhered to a tub or a drum are removed by the tub cleaning, it is possible to prevent secondary contamination of the laundry in the rinse cycle.

Third, after spin dry is performed to remove detergent adhered to laundry, a water level is increased by supplying water to the tub and the laundry is rinsed. Accordingly, an amount of water consumption may be reduced and rinse performance may improve.

Fourth, while the drum is rotated with laundry adhered thereto, rinse and hygiene cleaning are performed. Accordingly, the laundry may be rinsed uniformly and a capability of the laundry adhered to the drum to lift water during the hygiene cleaning may improve.

Fifth, as the tub cleaning can be performed with water used in rising the laundry, it is possible to keep the inside of the tub clean even without an additional tub cleaning course.

Sixth, it is possible to reduce foaming in the rinse cycle.

As described above, the method of controlling a washing machine described in this disclosure is an illustrative purpose only, and the present invention is not limited thereto. Thus, it should be understood that numerous other modifications and embodiments can be devised by those skilled in the art within the spirit and scope of the present invention and they will fall within the scope of the present invention.

What is claimed is:

1. A method of controlling a washing machine including a tub configured to receive water and a drum rotatably disposed in the tub and configured to receive laundry through an introduction hole defined at a front of the drum, the method comprising:

washing laundry received in the drum by water mixed with detergent;

performing a spin dry operation comprising:

rotating the drum at a spin dry speed to allow the laundry to rotate along with the drum and to be raised along an inner surface of the drum without falling from a highest point of the inner surface of the drum, and draining water from the tub while rotating the drum at the spin dry speed; and performing a rinse operation comprising:

decelerating the drum from the spin dry speed to a laundry adherence speed, supplying a first water supply to the drum, draining the first water supply from the tub, and supplying a second water supply to the drum, wherein the laundry adherence speed is set within a range of a rotation speed of the drum that allows the laundry to rotate along with the drum and to be raised along the inner surface of the drum without falling from the highest point of the inner surface of the drum during supplying the first water supply to the drum and supplying the second water supply to the drum.

2. The method of claim 1, wherein supplying the first water supply comprises supplying water to the drum until a water level of the tub increases to a level greater than or equal to a preset first water supply level.

3. The method of claim 1, wherein the rinse operation further comprises:

stopping draining the first water supply from the tub based on at least one of (i) a water level of the tub being decreased to a level less than or equal to a preset draining water level or (ii) an elapse of a preset draining time period while draining the first water supply from the tub.

4. The method of claim 2, wherein the rinse operation further comprises:

stopping draining the first water supply from the tub based on an elapse of a preset draining time period before the water level of the tub reaches a preset draining water level.

5. The method of claim 1, wherein the laundry adherence speed is between 60 rpm and 150 rpm.

6. The method of claim 1, further comprising:

after draining the first water supply from the tub, accelerating the drum from the laundry adherence speed to a tub cleaning speed, wherein the tub cleaning speed is set within a range of the rotation speed of the drum in which the laundry remains adhered to the drum and rotates along with the drum while a portion of the drum is submerged in water.

7. The method of claim 6, wherein the tub cleaning speed is less than the spin dry speed.

8. The method of claim 6, wherein the laundry adherence speed is closer to the tub cleaning speed than the spin dry speed.

9. The method of claim 6, wherein a deceleration duration for decelerating the drum from the spin dry speed to the laundry adherence speed is less than an acceleration duration for accelerating the drum from the laundry adherence speed to the tub cleaning speed.

10. The method of claim 1, wherein supplying the second water supply comprises supplying water until a water level of the tub increases to a level greater than or equal to a preset second water supply level.

11. The method of claim 1, wherein supplying the first water supply comprises supplying water to the tub while decelerating the drum from the spin dry speed to the laundry adherence speed.

12. The method of claim 1, wherein supplying the first water supply comprises starting supply of water at a start time point of deceleration of the drum.

13. The method of claim 1, wherein the spin dry operation further comprises accelerating the drum from the laundry adherence speed to the spin dry speed.

14. The method of claim 1, wherein supplying the first water supply comprises starting supply of water in response to stopping draining water from the tub in the spin dry operation.

15. The method of claim 1, wherein supplying the first water supply comprises supplying water while maintaining the rotation speed of the drum at the laundry adherence speed.

16. The method of claim 15, wherein draining the first water supply from the tub comprises draining water while maintaining the rotation speed of the drum at the laundry adherence speed.

17. The method of claim 16, wherein supplying the second water supply comprises supplying water while maintaining the rotation speed of the drum at the laundry adherence speed.

18. The method of claim 1, wherein the rinse operation further comprises:

determining a water level of the tub while supplying the first water supply to the drum;

comparing the water level of the tub to a preset first water supply level;

based on the comparison of the water level of the tub to the preset first water supply level, determining that the water level of the tub is greater than or equal to the preset first water supply level; and based on the determination that the water level of the tub is greater than or equal to the preset first water supply level, stop supplying water to the drum.

19. The method of claim 1, wherein the rinse operation further comprises:

comparing a drainage time elapsed during draining the first water supply from the tub to a preset draining time period;

based on the comparison of the drainage time to the preset draining time period, determining that the drainage time is less than or equal to the preset draining time period;

based on the determination that the drainage time is less than or equal to the preset draining time period, comparing a water level of the tub to a preset draining water level;

based on the comparison of the water level of the tub to the preset draining water level, determining that the water level of the tub is decreased to a level less than or equal to the preset draining water level; and based on the determination that the water level of the tub is decreased to the level less than or equal to the preset draining water level, stopping draining the first water supply from the tub.

20. The method of claim 1, wherein the spin dry operation further comprises:

maintaining the rotation speed of the drum at a first spin dry speed greater than the laundry adherence speed;

decelerating the drum from the first spin dry speed to the laundry adherence speed;

based on decelerating the drum from the first spin dry speed to the laundry adherence speed, maintaining the rotation speed of the drum at the laundry adherence speed;

accelerating the drum from the laundry adherence speed to a second spin dry speed greater than the first spin dry speed; and based on accelerating the drum from the laundry adherence speed to the second spin dry speed, maintaining the rotation speed of the drum at the second spin dry speed.

* * * * *